US007726642B2

(12) United States Patent
Panunto et al.

(10) Patent No.: US 7,726,642 B2
(45) Date of Patent: Jun. 1, 2010

(54) LARGE CAPACITY BOTTOM FEED DISPENSER

(75) Inventors: John P. Panunto, Oakville (CA); Man Ho Robin Ho, Scarborough (CA)

(73) Assignee: PSI Peripheral Solutions, Inc., Mississauga, ON (CA)

( * ) Notice: Subject to any disclaimer, the term of this patent is extended or adjusted under 35 U.S.C. 154(b) by 474 days.

(21) Appl. No.: 10/660,533

(22) Filed: Sep. 12, 2003

(65) Prior Publication Data

US 2005/0067751 A1 Mar. 31, 2005

(51) Int. Cl.
*B65H 5/00* (2006.01)

(52) U.S. Cl. ..... 271/10.01

(58) Field of Classification Search ..... 271/270, 271/35, 10.02, 10.03, 10.07, 10.06, 265.02, 271/131, 165, 121, 124, 125, 138
See application file for complete search history.

(56) References Cited

U.S. PATENT DOCUMENTS

| | | | | | |
|---|---|---|---|---|---|
| 3,612,511 | A | * | 10/1971 | Godlewski | 271/35 |
| 4,030,722 | A | | 6/1977 | Irvine et al. | |
| 4,928,944 | A | * | 5/1990 | Golicz | 271/6 |
| 4,978,114 | A | * | 12/1990 | Holbrook | 271/35 |
| 4,982,942 | A | | 1/1991 | Konishi et al. | |
| 5,244,197 | A | * | 9/1993 | Helmstadter | 271/35 |
| 5,358,229 | A | * | 10/1994 | Groel et al. | 271/3.06 |
| 5,498,123 | A | | 3/1996 | Alicea | |
| 5,641,155 | A | * | 6/1997 | Bridges | 271/35 |
| 5,711,518 | A | * | 1/1998 | Portaro et al. | 271/10.03 |
| 5,755,336 | A | * | 5/1998 | Rudy | 209/539 |
| 5,769,408 | A | | 6/1998 | Selak et al. | |
| 5,888,047 | A | | 3/1999 | Auerbach et al. | |
| 6,550,764 | B2 | * | 4/2003 | Wilson et al. | 271/270 |
| 2003/0197324 | A1 | * | 10/2003 | Cook | 271/35 |
| 2003/0234158 | A1 | * | 12/2003 | Zattler | 198/454 |

* cited by examiner

*Primary Examiner*—Patrick Mackey
*Assistant Examiner*—Thomas A Morrison
(74) *Attorney, Agent, or Firm*—Marks & Clerk

(57) ABSTRACT

A dispenser for dispensing flat media comprises a media storage bin at a first end and a discharge chute at a second end, with a coarse media separator located adjacent the media storage bin and a rear conveyor which is intermittently driven to convey the media towards a singulation separator, having a front conveyor which delivers media to a transport conveyor and to a discharge chute. A sensor senses media at a location just before the singulation separator. Media from the bottom of the storage bin are pass through the coarse media separator and lie on the rear conveyor in shingled arrangement, and are pulled into the singulation separator one at a time. The rear conveyor works only when the sensor senses the absence of media.

10 Claims, 5 Drawing Sheets

LARGE CAPACITY BOTTOM FEED DISPENSER

FIELD OF THE INVENTION

This invention relates to document dispensers and, more particularly, relates to bottom feed document and media dispensers which can handle a large capacity of documents or other media at the loading stage.

BACKGROUND OF THE INVENTION

Document dispensers are well known and have been used in a variety of document handling applications with great commercial success over the years. Generally, such dispensers are used to handle sheet-like materials such as papers, envelopes, catalogues, credit cards, business cards, and other similar items.

In practice, the document dispensers are typically used in connection with various types of document processing systems, such as printers, folding machines for properly folding the printed materials, laminators, accumulating machines for properly arranging the customized printed document or documents with all of the insert materials, inserting machines for inserting the collations into envelopes, labellers, mailing machines which close and seal the flaps of the envelopes, and print a postage indicia thereon, and sorters for sorting out the printed envelopes. Often, the document dispensers are used as the front side of a fully automatic system.

In a typical arrangement of a document processing systems, there may be a stack of documents loaded onto a loading end of a document dispenser. The documents are generally stacked in a vertical manner with each of the documents lying in a horizontal plane. When the dispenser is in operation, a separating mechanism typically first separates the document from the stack, and then the document passes through a feeding mechanism which feeds the separated document into another apparatus for further processing. There are two common designs of dispensers which are available in the existing market. There are bottom feed dispensers and top feed dispensers. In a bottom feed dispenser, the document is removed from the bottom of the stack and then fed into the feeding portion of the dispenser. In a top feed dispenser, on the other hand, the document is removed from the top of the stack and then fed into the feeding portion of the dispenser. Furthermore, depending on the type of document being dispensed by the document dispenser, the dispenser may utilize friction rollers, reciprocating friction pusher feed elements, vacuum lift, vacuum pusher feed elements, grippers, or clamp type devices.

Generally, a desirable characteristic of the document dispenser is the capability of handling a large through-put at a high rate of speed so as to optimize the costs of the manufacturing and the maintenance of the various components of the dispenser. However, as in many document dispensers of this type, the dispensers are susceptible to paper jams, double feeds, and other unacceptable conditions if a wide range of documents of varying thicknesses are fed into the dispenser. In many instances, the dispenser needs to be adjusted each time when documents of different thicknesses are fed into the dispenser, thus leading to down-time of the dispenser.

In U.S. Pat. No. 5,498,123 issued to ALICEA on Mar. 12, 1996, a bottom feeding mechanism is taught. In particular, the mechanism is used for feeding media only one piece at a time to a functional unit, such as a printer. The bottom feeding mechanism comprises a feed roller assembly and a conveyor belt assembly functioning as a first stage gate and a set of snubber rollers functioning as a second stage gate. The feed roller and the conveyor belt can only move unidirectionally, which are controlled by a driving means through one-way clutches. Further, each snubber roller is independently driven. When a medium is fed to hit the gate, vertical component of momentum of the feeding mechanism forces the conveyor belt deflecting the leading edge and opens up the gap to its proper opening to allow one piece of media to pass through. Should more than one piece pass through the first stage gate, the second stage gate will virtually eliminate the possibility of more than one piece passing through this gate.

In U.S. Pat. No. 5,888,047 issued Mar. 30, 1999 to AUERBACH et al., a separating and feeding machine for bound booklets is taught. The separating and feeding machine is used for the removal of a succession of bound booklets from a supply hopper which is adapted to hold a stack of the booklets and for the feeding of the booklets to a subsequent apparatus for further processing. The machine includes a reciprocating vacuum feed plate, and first and second stage separating mechanism. The reciprocating vacuum feed plate is disposed in the bottom of the hopper which is used for advancing the bottom booklet through a discharge opening to a take away feed mechanism. When the machine is in use, the first and second stage separating mechanism initially maintains at least the bottom two booklets in the hopper in a shingled relationship such that a marginal portion of the adjacent bound booklet is exposed. A pressing member is then applied to maintain a normal force on the exposed marginal portion of the bottom booklet so as to prevent it from wrinkling and becoming jammed in the discharge opening when the vacuum feed plate is moving the booklet toward the discharge opening. The second stage separating separator then further ensures that only one booklet at a time can pass through the discharge opening.

In U.S. Pat. No. 4,030,722 issued to IRVINE et al. on Jun. 21, 1977, a sheet-material separator and feeder system is taught. The sheet-material separating and feeding system is used for the handling of a wide range of sheet thicknesses and sizes at high speed. Further, the system does not require on-going adjustments or a pre-sorting of materials. When in use, the sheets are stacked at one end of the system, and are then fed to a first of two separator mechanisms. The first separator mechanism is adjusted for thicker sheets of the range. Sheets leaving the first separator are subsequently fed to the second of the two separator mechanisms. The second separator is adjusted for thinner sheets of the range. Sheets leaving the second separator are ejected one at a time. The ejected sheets can be fed to other sheet handling equipment for processing. Generally, the sheet-material separator and feeder system as taught in this patent is directed for sheet-like materials such as envelopes, letters and pieces of mail.

In U.S. Pat. No. 5,769,408 issued to SELAK et al. on Jun. 23, 1998, an apparatus for feeding sheets is taught. In particular, the patent teaches a system for feeding a stack of sheets at a high rate of speed which prevents the sheets from bottlenecking or jamming in the sheet feeder. The sheet feeder includes a platform supporting a stack of sheets, feed rollers and downstream pull rollers, and first and second sensors. The first sensor detects the sheet and controls the on/off driving mechanism for the feed rollers. The second sensor detects the sheet and controls the on/off driving mechanism for the pull rollers. When in use, the feed roller section moves the sheets one at a time to the pull roller section.

Finally, in U.S. Pat. No: 4,982,942 issued to KONISHI et al. on Jan. 8, 1991, a sheet feed mechanism is taught. In particular, the sheet feed mechanism is used for feeding sheets one at a time. The mechanism comprises a hopper loaded with a stack of sheets, a feed roller disposed near the outlet of the hopper, and a resilient tongue which is held in resilient contact with the central section of the feed roller. The central section of the feed roller is provided with an alternate circumferential arrangement of low friction and high friction portions. The feed roller is designed such that the friction coefficients between the sheet and the low friction portions is smaller than that between the sheet and the tongue, and the friction coefficient between the sheet and the high friction portions is greater than that between the sheet and the tongue.

It will be apparent from the foregoing prior art that the initial height of the stack of documents at the loading end of the dispenser in some instances is limited, especially for dispensers which employ a bottom feed mechanism.

SUMMARY OF THE INVENTION

In keeping with the principal aspects of the present invention, there is provided a dispenser for dispensing flat media seriatim from a discharge end thereof remote from a media storage end thereof, wherein the dispenser comprises a media storage bin at a first end thereof and a discharge chute at a second end thereof.

A first coarse media separator is located adjacent the media storage bin at a first end of a driven rear conveyor which is intermittently driven at a first linear velocity $V_R$ to convey the media towards a second single media separator.

A driven front conveyor is associated with the single media separator, and is intermittently driven at a second linear velocity $V_F$.

A transport conveyor is located after the front conveyor, between the front conveyor and the discharge chute. It is also driven at a third linear velocity $V_T$.

There is a first sensor for sensing the presence or absence of media at the discharge end of the transport conveyor.

There is a second sensor for sensing the presence or absence of media on the transport conveyor.

There is also a third sensor for sensing the presence or absence of media at a location between the front conveyor and the rear conveyor.

Thus, media from the bottom of the storage bin are permitted to pass through the coarse media separator from the bottom of the storage bin in quantities of at least one media element, and are permitted to lie on the rear conveyor in single or shingled arrangement in which the leading edge of a media element overlies the trailing edge of the next adjacent media element which is closer to the single media separator.

Media which are lying on the rear conveyor are pulled into the single media separator one at a time by the front conveyor, and they are delivered by the front conveyor to the transport conveyor seriatim.

The rear conveyor operates only when the third sensor senses the absence of media thereat.

Typically, the dispenser of the present invention operates in such a manner that $V_F > V_R$, and $V_T \geqq V_F$.

In any dispenser in keeping with the present invention, the storage bin may be arranged vertically or may be inclined rearwardly at an angle less than 30° from the vertical.

Typically, each of the rear and front conveyors comprises at least two parallel conveyor belts.

In most instances, the transport conveyor comprises upper and lower conveyors each having at least two parallel conveyor belts arranged so that the distance between the upper conveyor and lower conveyor is sufficient to secure single media elements therebetween in driving relationship therewith.

As examples of typical media that may be dispensed be a dispenser in keeping with the resent invention, the individual media elements may be chosen from the group consisting of: sheets of paper, pamphlets, booklets, brochures, catalogs, magazines, envelopes, CDs or DVDs in slip cases, CDs or DVDs in crystal cases or presentation cases, flyers, books, and, combinations thereof.

In dispensers according to the present invention, each of the coarse media separator and the single media separator is vertically adjustable so as to accommodate the thickness of the individual media elements to be dispensed during an operating cycle of the dispenser.

In operation, the first sensor operates to stop operation of the transport conveyor when it senses the presence of media thereat.

Usually, dispensers in keeping with the present invention further comprise a box ready sensor to sense when a receiver for media being discharged from the discharge chute is capable of receiving more media, and which operates to start operation of the transport conveyor when a box ready event occurs.

Typically, whenever the front conveyor starts its operation, the transport conveyor also starts its operation.

In dispensers according to the present invention, each of the coarse media separator and the single media separator comprises a nip roller which overlies the respective rear or front conveyor. Thus, media elements are pulled through the respective separator by the frictional engagement of the bottommost media element in a quantity determined by the vertical spacing of the respective nip roller away from the respective conveyor.

In general, the rear conveyor comprises a plurality of conveyor belts arranged lengthwise along the dispenser, each being driven at the first linear velocity $V_R$.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
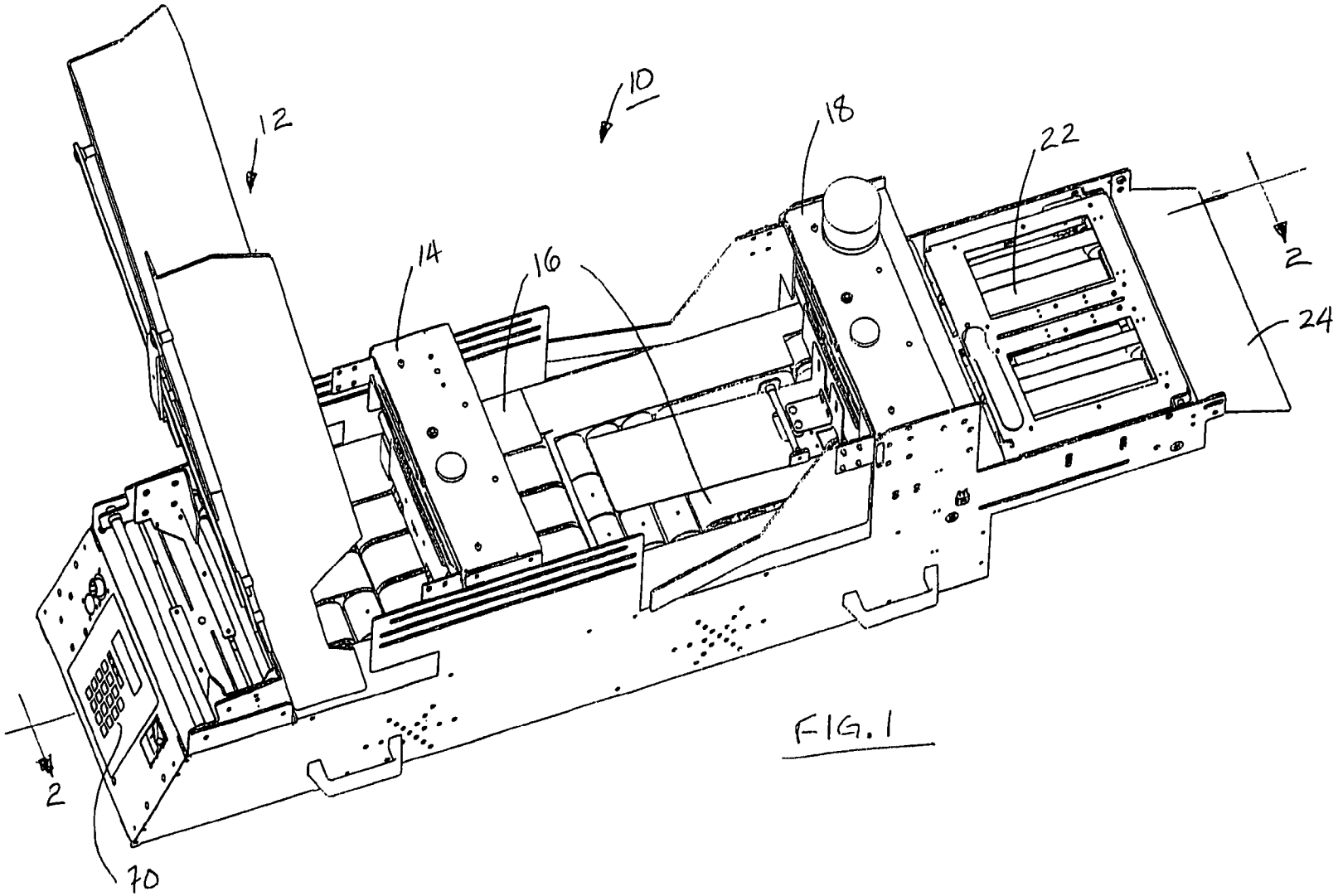
FIG. 1 is a perspective view from the right hand side of a dispenser in keeping with the present invention, showing the major structural features thereof.

The novel features which are believed to be characteristic of the present invention, as to its structure, organization, use and method of operation, together with further objectives and advantages thereof, will be better understood from the following discussion.

A general discussion of the operation of bottom feed dispensers now follows. It is well known in the printing and copying art that machines to feed sheets of paper, in particular, for handling media to be copied or printed upon, may function either to take the topmost or the bottommost sheet of paper. This is usually accommodated by the functional interrelationship between a moving conveyor and a nip roller. However, in industrial circumstances where a plurality of media—which are not necessarily sheets of paper but which might comprise catalogs or flyers, booklets, CDs or DVDs, and the like—are to be dispensed one at a time, then for the sake of efficiency it is convenient to remove the bottommost media element from a stack of media elements so that additional inventory may be placed onto the stack of media elements without the necessity of having to stop the feeding operation of media elements to and/or through the dispenser.

Moreover, when individual media elements, or even small quantities of media elements, are bottom fed to a conveyor, the feeding operation relies particularly and significantly upon the frictional engagement of the bottommost media element with the conveyor upon which it is resting. A certain amount of inertia may also come into play, thereby assuring gravity feed of the media elements to the conveyor.

As noted above, most of the prior art relies upon arranging media elements from a single separator so that they may be dispensed one at a time. However, the present inventors have quite unexpectedly discovered that a particularly efficient dispenser can be provided wherein there is a first plurality of media elements that may be bottom fed onto a first or rear conveyor in a dispenser machine, and thereafter the dispenser can be adjusted and arranged so that the media elements are fed seriatim, one at a time, for further handling. The singulation separator therefore can function substantially continuously in such a manner that new inventory of media elements to be handled by the singulation separator are fed to it only when a sensor senses the absence of a media element at the singulation separator. Upon such an occurrence, a signal is sent to a coarse separator which functions in association with a media storage bin so as to remove at least one and typically a small plurality of media elements from the bottom of the storage bin. When a plurality of media elements is removed from the storage bin, and the conveyor onto which they fall or are placed as a consequence of their being bottom fed onto the conveyor is moving away from the storage bin, then typically the media elements will arrange themselves onto the conveyor in a shingled fashion. That is, the leading edge of each individual media element will overlie the trailing edge of the next adjacent media element towards the singulation separator.

Figure 2:
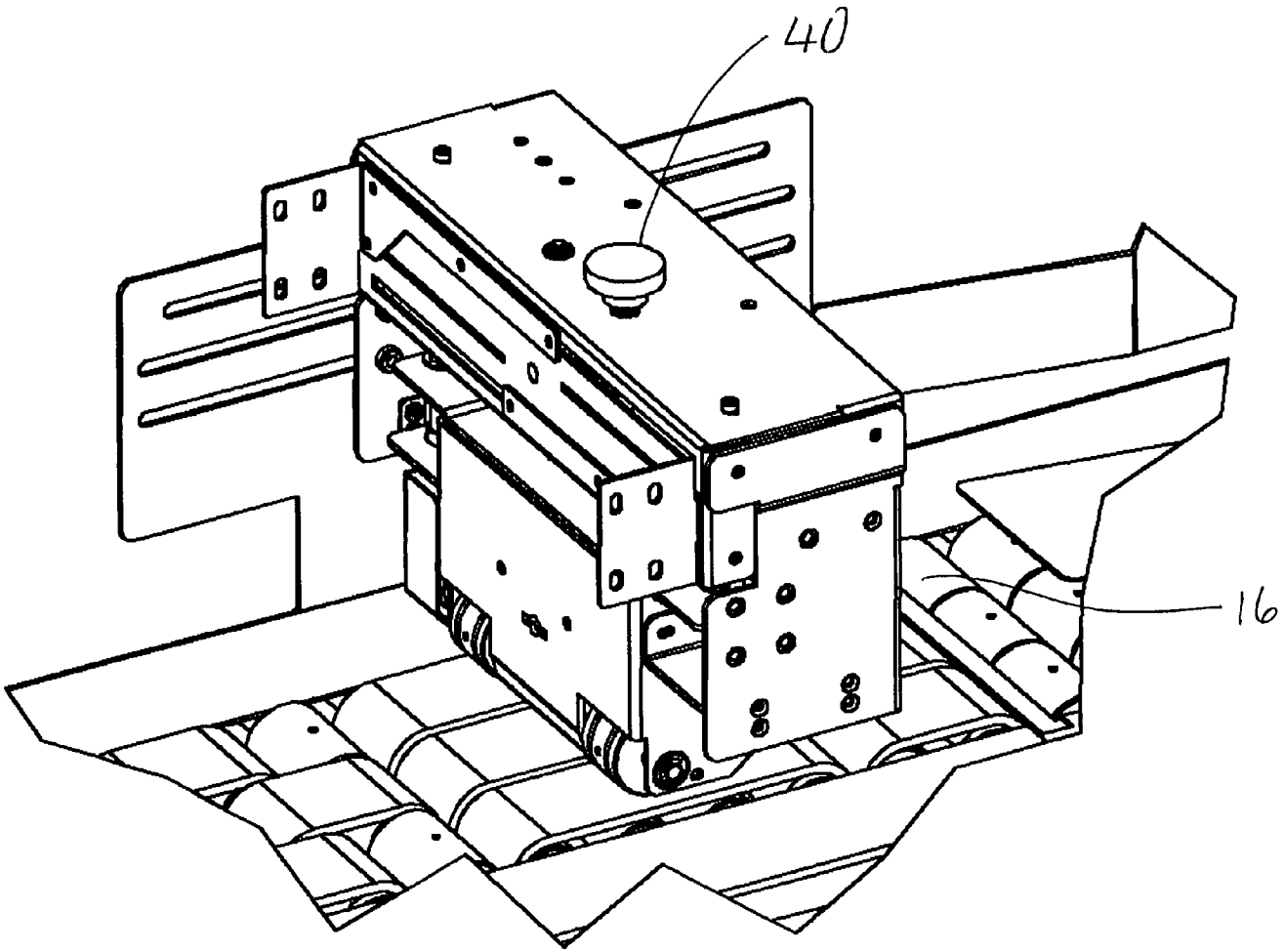
FIG. 2 is an exploded view of the coarse media dispenser shown in FIG. 1.

Referring now to FIG. 1, a dispenser whose purpose is to dispense flat media seriatim for further handling, is shown at 10. The principal features or elements of the dispenser include the following: there is a media storage bin 12 into which a plurality of individual media elements 50 (not shown in FIG. 1) are placed. A coarse media dispenser 14 is located forward of the media storage bin 12, and it overlies a driven rear conveyor 16. In fact, the rear conveyor 16 extends forwardly well beyond the coarse media dispenser 14, and as described hereafter comprises a plurality of driven belts, and may further comprise driven and/or idler rollers. An exploded view of the coarse media dispenser 14 is shown in FIG. 2. There is a single media separator or singulation separator 18 which overlies a driven front conveyor 20 (see FIG. 3). Located forwardly of the singulation separator 18 there is a transport conveyor 22; and located forwardly of the transport conveyor 22 there is a discharge chute 24. Specifically, an exploded view of the singulation separator 18 is shown in FIG. 4.

Figure 3:
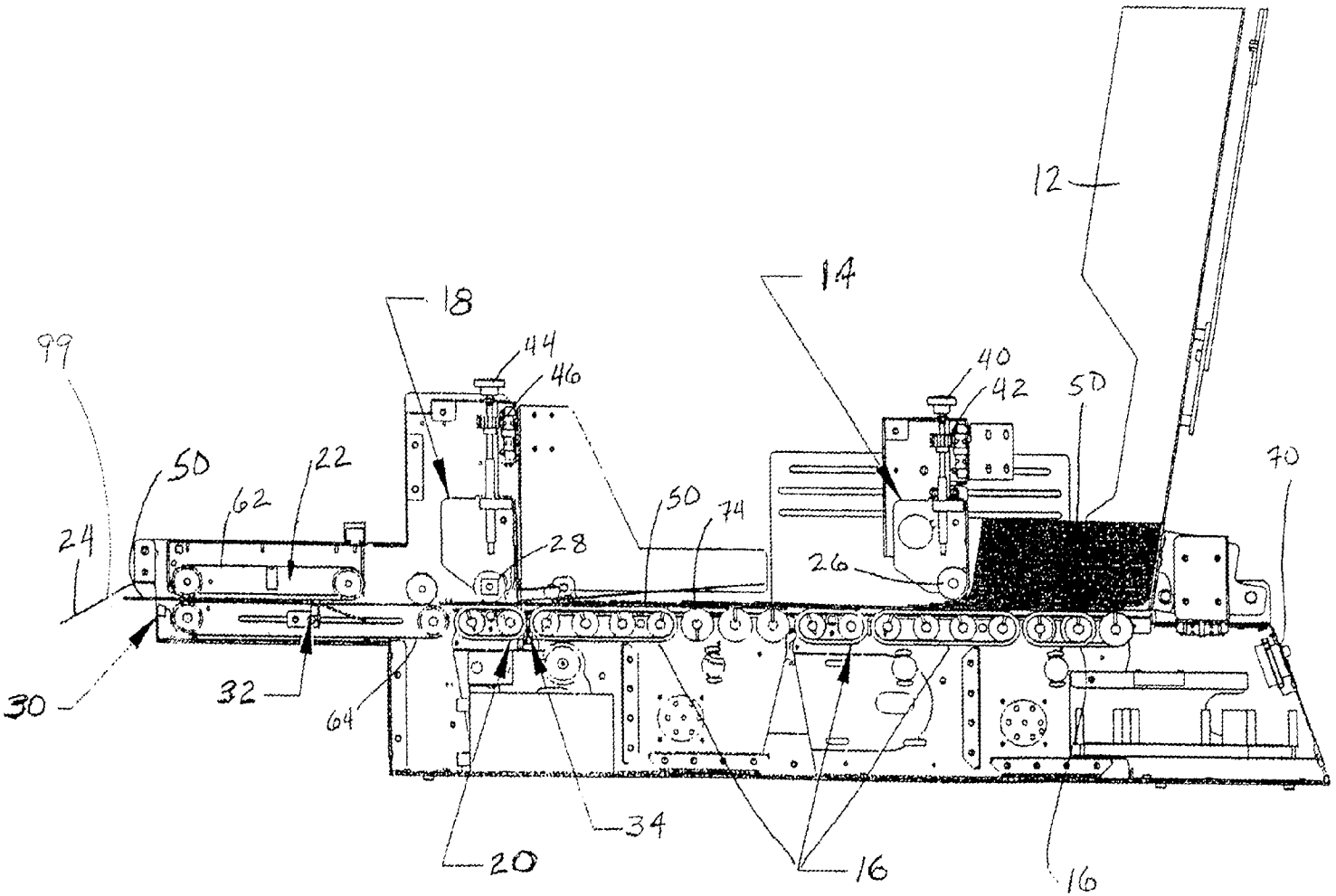
FIG. 3 is a side elevation taken from the left side of the dispenser of FIG. 1, taken along the line 2-2.
Figure 4:
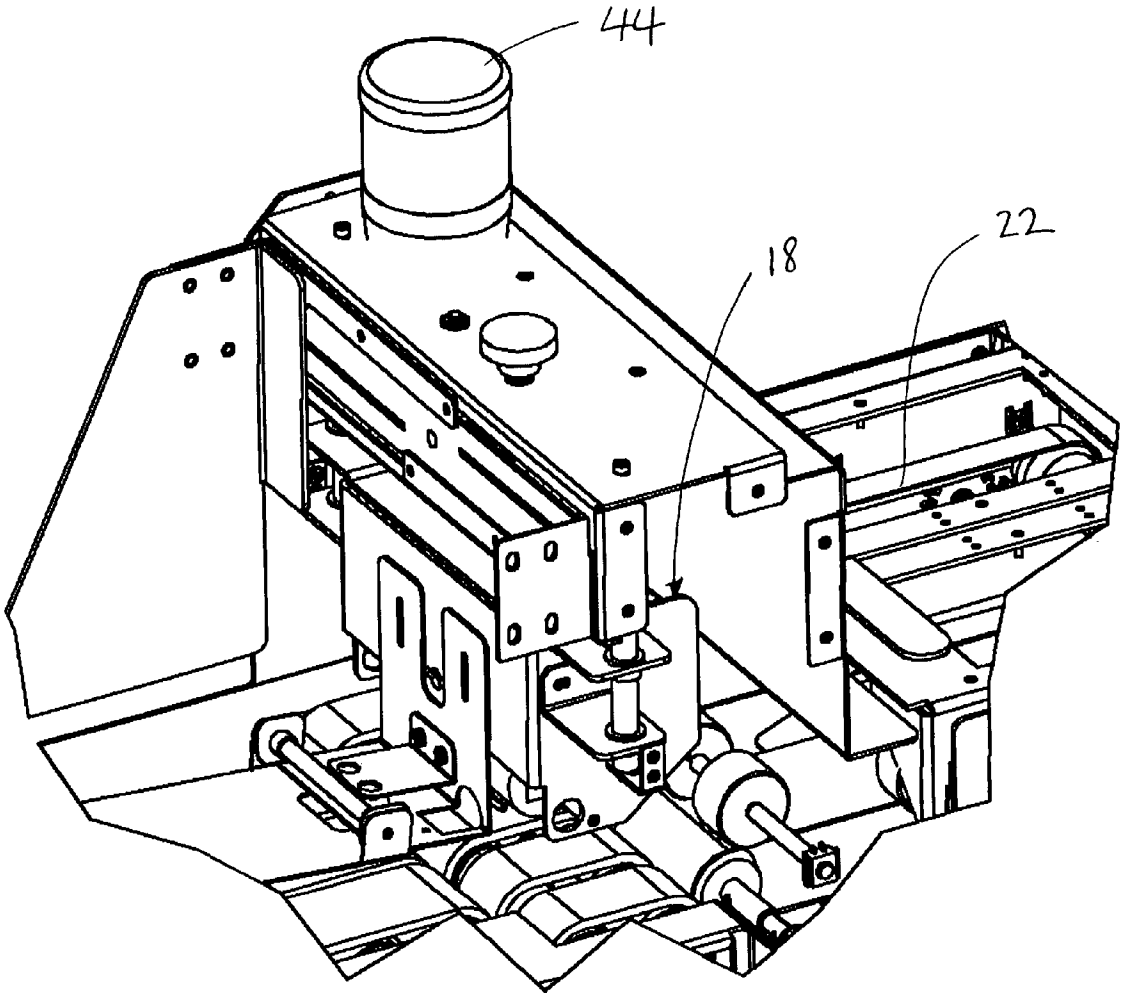
FIG. 4 is an exploded view of the singulation separator shown in FIG. 1.

Referring also to FIG. 3, the dispenser of the present invention comprises three sensors which are designated as a first sensor 30, a second sensor 32, and a third sensor 34. It is the purpose of the first sensor 30 to sense the presence or absence of media at the region of the discharge chute 24. The purpose of the second sensor 32 is to sense the presence or absence of media on the transport conveyor 22. It is the third sensor 34 which has a particularly important function, and that is to sense the presence or absence of media in the location of the third sensor 34, which is located between the rear conveyor 16 and the front conveyor 20.

It can be seen in FIG. 3 that a plurality of media elements 50 are stacked into the media storage bin 12. It will also be seen that the height of the nip roller 26 of the coarse media separator 14 above the rear conveyor 16 is such that several media elements 50 are capable of passing underneath the nip roller 26 as they are fed forwardly towards the discharge end of the dispenser when the rear conveyor 16 is driven. It is seen, of course, that the media elements 50 are being bottom fed from the media storage bin 12. It will also be seen in FIG. 3 that the individual media elements 50 may be arranged in a shingled manner, whereby the leading edge of each individual media element 50 overlies the trailing edge of the individual media element 50 which is next adjacent and which is closer to the singulation separator 18. However, it will also be understood that the height of the nip roller 28 above the driven front conveyor 20 is such that only a single media element 50 will pass between the nip roller 28 and the driven front conveyor 20.

The adjustment of the nip rollers 26 and 28 is outside the scope of the present invention. However, a typical arrangement for that adjustment is shown in FIG. 3. An adjustment knob 40 or 44 is provided for each of the coarse media separator 14 and the singulation separator 18, respectively, and each of those adjustment knobs 40, 44 acts to drive a gear and worm arrangement 42, 44 respectively so as to lift and lower the respective nip roller 26 or 28. Typically, the coarse media separator 14 may be adjusted so as to permit as few as two or three individual media elements 50, or as many as 10 or 15 individual media elements 50, to pass beneath the nip roller 26 whenever the rear conveyor 16 is driven.

On the other hand, the adjustment of the singulation separator 18 is such that the height of the nip roller 28 above the front conveyor 20 permits passage of a single media element 50 but precludes passage of two media elements 50. It will be understood that, for any specific media element 50, once the adjustments of the coarse media separator 14 and the singulation separator 18 are made, they will remain as adjusted until that particular operating cycle of the dispenser 10 for specific media elements 50 has been concluded.

It has been noted above that each of the conveyors operates at a specific designated linear speed. Thus, the speed of the rear conveyor 16 is designated $V_R$, and whenever rear conveyor 16 is operating it will carry media elements 50 towards the singulation separator 18 at the speed $V_R$. The speed of the front conveyor 20 is designated $V_F$, which is the linear speed at which individual media elements 50 will be driven away from the singulation separator 18. Typically, so as to ensure that each individual media element 50 is carried away from the singulation separator 18 at a faster speed then the media elements 50 are fed into the singulation separator 18, the speed $V_F > V_R$.

The transport conveyor 22 also has its own designated linear speed $V_T$. It will be understood that typically the transport conveyor 22 comprises upper and lower conveyor belts which are typically arranged in pairs, and are shown at 62 and 64, respectively. Of course, the linear speed of each of the conveyor belts 62 and 64 is the same, and typically that speed $V_T$ is equal to or greater than $V_F(V_T \geqq V_F)$. Moreover, the spacing between the conveyor belts 62, 64 is such as to accommodate only a single media element 50 between them, and to have a driving relationship therewith.

Now, it will be understood that when the situation occurs that there is no media element 50 overlying the third sensor 34, then the rear conveyor 16 will be driven until such time as the leading individual media element 50 once again overlies the sensor 34, at which time the driving action of the rear conveyor 16 will stop. Of course, it is also understood that all machine functions of the dispenser 10 of the present invention are under the control of a control panel 70 and the microprocessor intelligence associated therewith.

The nature of individual media elements 50 that are to be dispensed by the dispenser machine in keeping with the present invention, may vary considerably from operating cycle to operating cycle. For example, the media elements may be such as sheets of paper, but more particularly they may be items that have significant thickness such as pamphlets, booklets, brochures, catalogs, magazines, or envelopes which may be stuffed or unstuffed. Other typical media elements that may be dispensed seriatim in keeping with the present invention include books, and even CDs or DVDs that may be in slip cases, crystal cases, or presentation cases. The listing of typical media elements is intended for purposes of illustration only, and is not intended in any way to limit the scope or the understanding of the present invention.

Depending on the nature of the individual media elements 50, the media storage bin 12 may be arranged so as to be vertical with respect to the rear conveyor 16, or it may be inclined rearwardly as shown in FIGS. 1 and 2. If so, the typical angle of inclination is less than 30° from the vertical—that is, more than 60° from the horizontal.

Figure 5:
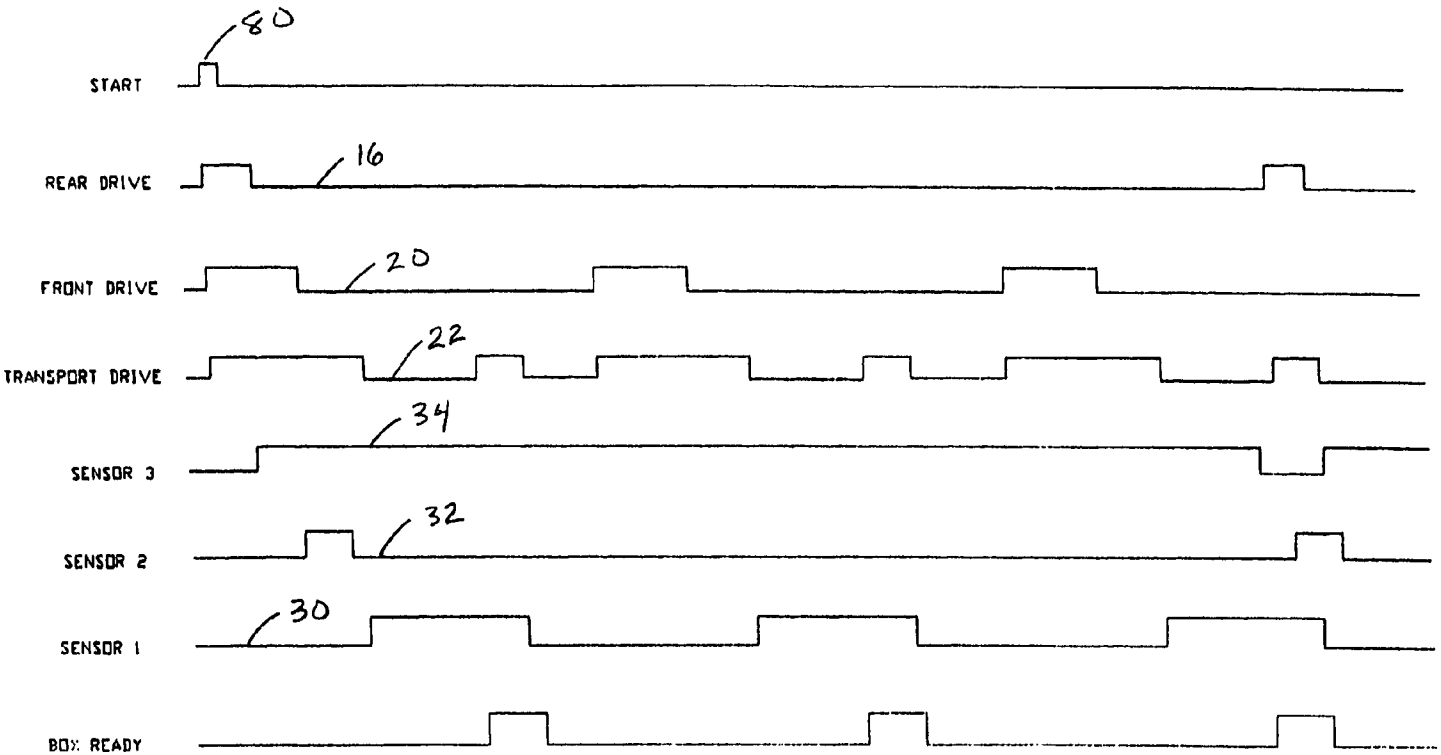
FIG. 5 is a timing diagram of a number of the operating elements of the dispenser.

In general, operation of the first sensor 30 will be such as to stop operation of the transport conveyor 22 when the presence of media elements 50 is sensed. Indeed, a review of the timing chart as it is shown in FIG. 5 indicates that, in the first instance, the rear conveyor 16, the front conveyor 20, and the transport conveyor 22 are all being driven when an operating cycle of the dispenser is initiated as at 80. Moreover, it will be understood that as soon as the third sensor 34 senses the presence of media elements 50 above it, drive operation of the rear conveyor 16 is terminated. However, it will also be understood that whenever the front conveyor 20 starts its operation, so also does the transport conveyor 22 start its operation.

Typically, the dispenser 10 dispenses individual media elements 50 down the discharge chute 24 to another conveyor, a transport box, tote, or otherwise. In any event, the receiver for the dispensed individual media elements 50 may be termed to be a box, and as such its ability to receive more individual media elements 50 may be determined by a box ready sensor 99. It will be understood, however, that whenever a box ready event occurs, operation of the transport conveyor will again begin, irrespective of the operating condition of the front conveyor 20.

It will be noted from FIGS. 1 and 2 that the rear conveyor 16 comprises a plurality of conveyor belts which are arranged lengthwise along the dispenser 10. Moreover, at least one roller 74 may also be driven at the same linear speed $V_R$ as the rear conveyor 16, while other rollers that may also be arranged along the line of the rear conveyor 16 may be idler rollers.

There has been described a dispenser whose function is to dispense a plurality of individual flat media elements, seriatim, to a discharge chute for further handling. The individual media elements are bottom fed from a media storage bin, so that operation of the dispenser can be substantially continuous. The individual media elements are fed on demand by a transport conveyor to the receiving chute and thence for further handling, but the operation of the conveyor which bottom feeds media elements from the media storage bin is independent of the rate at which media elements leave the dispenser at the discharge chute. This is accomplished as a consequence of having two separators, a first coarse media separator and a second singulation separator. Operation of the singulation separator and the supply of individual media elements to be separated thereby is controlled by sensing the presence or absence of media elements at the singulation separator.

An understanding of the dispenser of the present invention will be clear from a review of the above discussion and with reference to the accompanying Figures of drawings.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially continuous means more or less continuously but permits stoppage of the operation from time to time.

What is claimed is:

1. A dispenser for dispensing flat media seriatim to a discharge end, comprising:

a media storage bin for storing a stack of flat media elements, the bin having a bottom end;

a driven rear conveyor extending under the bottom end of the media storage bin for carrying away flat media elements from the bottom of the stack in a shingled relationship wherein the flat media elements lie flat on the conveyor with the leading edge of one said media element overlying the trailing edge of a preceding said media element, the driven rear conveyor being driven intermittently at a first linear velocity $V_R$;

a coarse media separator comprising a first nip roller defining a first nip with the rear conveyor, said first nip roller cooperating with the rear conveyor to feed said media elements off the bottom of the stack onto said rear conveyor in said shingled relationship;

a first height adjustment mechanism for setting a first vertical spacing between the first nip roller and the rear conveyor to allow said media elements to pass through said first nip in said shingled relationship;

a driven front conveyor downstream of said rear conveyor for receiving the flat media elements from the rear conveyor, the driven front conveyor being driven intermittently at a second linear velocity $V_F$;

a single media separator comprising a second nip roller cooperating with said driven front conveyor to define a second nip to separate said shingled media elements received from the rear conveyor into single media elements;

a second height adjustment mechanism for setting a second vertical spacing between the second nip roller and the front conveyor to allow said media elements to pass through said second nip one at a time as separated media elements;

a transport conveyor for carrying the separated media elements from said front conveyor to said discharge end, the transport conveyor being driven intermittently at a third linear velocity $V_T$; and a first sensor responsive to the presence or absence of a media element at the discharge end to stop operation of the transport conveyor;

a second sensor responsive to the presence or absence of a media element on the transport conveyor to stop operation of the front conveyor; and a third sensor responsive to the presence or absence of a media element at an input to the front conveyor to stop operation of the rear conveyor.

2. The dispenser of claim 1, wherein $V_F > V_R$, and $V_T \geqq V_F$.

3. The dispenser of claim 2, wherein said media storage bin is arranged vertically or is inclined rearwardly at an angle less than 30° from the vertical.

4. The dispenser of claim 2, wherein each of said rear and front conveyors comprises at least two parallel conveyor belts.

5. The dispenser of claim 2, wherein said transport conveyor comprises upper and lower conveyors each having at least two parallel conveyor belts arranged so that the distance between the upper conveyor and lower conveyor is sufficient to secure single media elements therebetween in driving relationship therewith.

6. The dispenser of claim 2, wherein said media elements are chosen from the group consisting of: sheets of paper, pamphlets, booklets, brochures, catalogs, magazines, envelopes, CDs or DVDs in slip cases, CDs or DVDs in crystal cases or presentation cases, flyers, books, and, combinations thereof.

7. The dispenser of claim 2, wherein said first sensor operates to stop operation of said transport conveyor when it senses the presence of media thereat.

8. The dispenser of claim 7, further comprising a box ready sensor to sense when a receiver for media being discharged from said discharge end is capable of receiving more media, and which operates to start operation of said transport conveyor when the receiver is capable of receiving more media.

9. The dispenser of claim 7, wherein whenever said front conveyor starts its operation, said transport conveyor also starts its operation.

10. The dispenser of claim 2, wherein said rear conveyor comprises a plurality of conveyor belts arranged lengthwise along said dispenser, each being driven at said first linear velocity $V_R$.

* * * * *